US005709090A

United States Patent [19]

Endo et al.

[11] Patent Number: 5,709,090

[45] Date of Patent: Jan. 20, 1998

[54] REFRIGERATING SYSTEM AND OPERATING METHOD THEREOF

[75] Inventors: Takeshi Endo, Shimizu; Hirokiyo Terada, Shizuoka; Naoto Katsumata; Kensaku Oguni, both of Shimizu; Kazumoto Urata, Shizuoka; Masatoshi Muramatsu; Michiko Endo, both of Shimizu, all of Japan

[73] Assignee: Hitachi, Ltd., Japan

[21] Appl. No.: 562,950

[22] Filed: Nov. 27, 1995

[30] Foreign Application Priority Data

Nov. 25, 1994 [JP] Japan ..... 6-290926

[51] Int. Cl.[6] ..... F25B 41/00; F25B 1/00

[52] U.S. Cl. ..... 62/81; 62/174; 62/502

[58] Field of Search ..... 62/81, 502, 174, 62/204, 324.4

[56] References Cited

U.S. PATENT DOCUMENTS 4,912,933 4/1990 Renken ..... 62/81

5,353,604 10/1994 Oguni et al. ..... 62/502 X

FOREIGN PATENT DOCUMENTS 61-55562 3/1986 Japan .

62-52368 3/1987 Japan .

*Primary Examiner*—William E. Wayner

*Attorney, Agent, or Firm*—Evenson, McKeown, Edwards & Lenahan, P.L.L.C.

[57] ABSTRACT

A refrigerating system having a refrigerating cycle constructed by connecting an accumulator, a refrigerant compressor, a four-way valve, an outdoor unit heat exchanger, an outdoor unit expander, a receiver, an indoor unit expander and an indoor unit heat exchanger sequentially by pipes. Normally, excessive refrigerant is stored in the receiver and when it becomes necessary to raise a ratio of lower boiling point refrigerants, a flow amount of the refrigerant is decreased by restricting the outdoor unit expander during the cooling operation or by restricting the indoor unit expander during the heating operation to move the excessive refrigerant within the receiver to the accumulator. Thereby, the composition of the refrigerant circulating within the refrigerating system using non-azeotrophic refrigerant mixtures may be changed without using a complicated system structure or control method thereof and the capacity of the refrigerating cycle may be changed.

17 Claims, 3 Drawing Sheets

REFRIGERATING SYSTEM AND OPERATING METHOD THEREOF

BACKGROUND OF THE INVENTION

1. Field of the Invention

The present invention relates to an air conditioner, comprising a refrigerating system having a receiver and an accumulator for storing excessive refrigerant, which operates so as to increase a lower boiling point refrigerant and which is suited for enhancing a capacity variable function of the air conditioner at low cost and for stabilizing the refrigerating cycle thereof.

2. Description of the Related Art

A capacity variable function is necessary to improve the comfortableness or to save energy of an air conditioner and the needs thereof is increasing year by year. As means for varying the capacity, capacitance control of a compressor whose number of revolutions can be varied by using an inverter is often used. This method, however, has had a problem that it significantly adds to the cost of the equipment.

There has been also known a method of changing the composition of refrigerant circulating within a refrigerating cycle during the operation thereof by using non-azeotrophic refrigerant mixtures, though the capacity variable range thereof is narrower than that of the method utilizing the inverter.

As described in Japanese Patent Laid-Open No. 62-52368 and Patent Laid-Open No. Hei. 1-88068 for example, the method of using the non-azeotrophic refrigerant mixtures in which more than two kinds of substances having different boiling points are compounded changes the composition of the circulating refrigerant by distilling it by providing a refrigerant rectifier unit or a refrigerant separator, together with heat exchanger means.

A method described in Japanese Patent Laid-Open No. 61-55562 controls the cooling and heating capability by storing liquid refrigerant in a gas-liquid separator.

The methods described above, however, require a special mechanism for controlling the composition, besides those structural elements which the normal refrigerating cycle is equipped with. Due to that, they have had problems that the system structure and the system control are complicated, that the system is costly and that the reliability thereof drops due to the instability of the control.

Meanwhile, a method of charging an amount of refrigerant sufficient for the longest pipe in advance is adopted for air conditioners to reduce labor in installation works. When an operating capacity fluctuates in such air conditioner or a multiple air conditioner in which a plurality of indoor units are connected to one outdoor unit, excessive refrigerant is produced in the air conditioner. Then, in order to absorb the excessive refrigerant, a receiver is provided at the outlet of a condenser as a refrigerant storage tank or an accumulator is provided before a refrigerant compressor. Then, if the composition of the non-azeotrophic refrigerant can be changed by using those structural elements, the air conditioner can be constructed without providing other special elements.

Further, HCFC 22, a refrigerant which had been widely used for refrigeration and air-conditioning, has been decided to be totally eliminated in the future because it is involved in the destruction of the ozonosphere, and the regulation on its usage is been tightened year by year. Due to that, a substitute for HCFC 22 has been demanded and as a candidate thereof, non-azeotrophic refrigerant mixtures of HFCs which are non-chloric fluorocarbon and which will not destroy the ozonosphere is hopeful.

In concrete, a substance in which HFC 32, HFC 125 and HFC 134a are mixed in the ratio of 23:25:52 (weight %) has been given a refrigerant No. R407C by ASHRAE and is about to be put into practical use. Further, a binary refrigerant mixture of HFC 32 and HFC 134a, which is superior in terms of the efficiency, the problem of global warming and the production cost, may be used, provided that its problem of flammability is solved.

Because HCFC 22 is replaced with such new non-azeotrophic refrigerant mixtures from now on, it is required to establish the technology for varying the composition of the circulating refrigerant.

It is also required to reduce an amount of charged refrigerant in order to reduce the influence on the global warming and to reduce the cost of the units.

SUMMARY OF THE INVENTION

Accordingly, it is an object of the present invention to solve the aforementioned problems of the prior art by providing a refrigerating system which can readily change the composition of circulating refrigerant in the system using non-azeotrophic refrigerant mixtures, i.e. a refrigerant in which more than two kinds of substances having different boiling points are mixed, by using only the structural elements used in the conventional refrigeration cycle.

It is another object of the present invention to provide the refrigerating system, using the non-azeotrophic refrigerant mixtures, in which an amount of refrigerant used is reduced.

It is a further object of the present invention to provide a method for operating the refrigerating system which can change the composition of the refrigerant circulating within the refrigerating system effectively while keeping the stable condition, while maintaining a wide operational range of the refrigerating system.

In order to achieve the aforementioned goals, the refrigerating system of the present invention in which an indoor unit and an outdoor unit are connected through pipes and in which the non-azeotrophic refrigerant mixtures is used comprises an outdoor unit expander whose restriction may be changed; an indoor unit expander whose restriction may be changed similarly; a receiver provided between the outdoor unit expander and the indoor unit expander; and a controller for turning both of a refrigerant flow at the inlet of the receiver and a refrigerant flow at the outlet thereof into a gas-liquid two-phase flow by changing the restriction of the outdoor unit expander and the indoor unit expander.

Further, a refrigerating system having a refrigerating cycle constructed by connecting a refrigerant compressor, condenser, a receiver, an evaporator and an accumulator sequentially by pipes and whose refrigerant circulating within the refrigerating cycle is non-azeotrophic refrigerant mixtures in which more than at least two kinds of substances having different boiling points are mixed, comprises first expanding means which is provided on the upstream side of the receiver and whose restriction may be changed; second expanding means which is provided on the downstream side of the receiver and whose restriction may be changed; and control means for turning both of a refrigerant flow at the inlet of the receiver and a refrigerant flow at the outlet thereof into a gas-liquid two-phase flow by changing the restriction of the first expanding means and the second expanding means.

It further comprises control means for reducing liquid refrigerant within the receiver and increasing liquid refrigerant within the accumulator by changing the restriction of the first expanding means and the second expanding means.

It further comprises a pipe, provided in the receiver, for taking out the liquid refrigerant; and gas refrigerant mixing means provided on the pipe for taking out liquid refrigerant.

In the refrigerating system described above, the non-azeotrophic refrigerant mixtures is what at least either difluoromethane or pentafluoroethane is mixed with 1,1,1,2-tetrafluoroethane.

The refrigerating system described above further comprises outside air temperature detecting means for detecting an outside air temperature and the restriction of the first expanding means and the second expanding means is controlled based on the outside air temperature.

The refrigerating system further comprises indoor unit temperature detecting means, provided in the indoor unit, for detecting a suction temperature of the indoor unit and the restriction of the outdoor unit expander and the indoor unit expander is controlled based on the suction temperature of the indoor unit.

In the refrigerating system described above, the refrigerant compressor is equipped with discharge pressure detecting means for detecting a discharge pressure and the restriction of the first expanding means and the second expanding means is controlled based on the discharge pressure.

In the refrigerating system described above, the refrigerant compressor is equipped with discharge temperature detecting means for detecting a discharge temperature and the restriction of the first expanding means and the second expanding means is controlled based on the discharge temperature.

The refrigerating system further comprises indoor unit blowoff temperature detecting means, provided in the indoor unit, for detecting a blowoff temperature of the indoor unit and the restriction of the outdoor unit expander and the indoor unit expander is controlled based on the blowoff temperature of the indoor unit.

In the refrigerating system described above, the non-azeotrophic refrigerant mixtures is R407C.

Further, a method for operating a refrigerating system equipped with an indoor unit and an outdoor unit comprising a refrigerant compressor, an outdoor unit heat exchanger, a receiver and an accumulator and using non-azeotrophic refrigerant mixtures is characterized in that an amount of the zeotropic refrigerant mixtures stored in the accumulator is increased during the heating operation when an outside air temperature drops.

The method described above is also characterized in that an amount of the non-azeotrophic refrigerant mixtures stored in the receiver provided between an outdoor unit expander and an indoor unit expander is decreased during the heating operation when an outside air temperature drops.

The method described above is also characterized in that the non-azeotrophic refrigerant mixture store in the accumulator is increased during the defrosting operation.

The method described above is also characterized in that the restriction of the outdoor unit expander and the indoor unit expander is controlled to increase lower boiling point refrigerants of the non-azeotrophic refrigerant mixtures circulating within the refrigerating cycle during the heating operation when an outside air temperature drops.

In the method described above, the restriction of the outdoor unit expander and the indoor unit expander is controlled based on at least either the outside air temperature or the suction temperature of the indoor unit.

When the refrigerating system in which the receiver is installed at the outlet of the condenser is operated, the excessive refrigerant within the refrigerating cycle is stored in the receiver in the state of saturated liquid (liquid refrigerant). At this time, the refrigerant contains a few bubbles at the inlet of the receiver and its dryness is almost zero. The gas refrigerant of such bubbles is then condensed by the heat radiating effect of the receiver and the dryness of the refrigerant at the outlet of the receiver becomes zero.

Thus, the balance of the gas refrigerant and the liquid refrigerant is taken at the outlet and inlet of the receiver, keeping the liquid level constant. As a result, the refrigerating cycle is stabilized.

The composition of the non-azeotrophic refrigerant mixtures such as R407C in the liquid phase and gas phase changes depending on the dryness in the saturation domain. In the liquid phase, its composition turns into what at the time when the dryness is zero, i.e. a composition in which a higher boiling point refrigerant is contained more than that at the time when the refrigerant has been charged. Accordingly, when the dryness of the refrigerant stored in the receiver is zero or close to zero, the fluctuation of circulation caused by the fluctuation of the composition of the stored refrigerant is negligible.

Meanwhile, the capacity of the refrigerating system is determined by a rated standard condition. However, the refrigerating system in which the refrigerant compressor is operated at a constant rate cannot exhibit its full capacity when the heating operation is performed when an outside air temperature is low. Then, in order to bring out the capacity of the refrigerating system, the composition of the refrigerant must be changed during the operation.

That is, when the restriction of the first expanding means provided on the upstream side of the receiver is restricted, the refrigerant is put into the saturation domain at the inlet of the receiver and the flow of the refrigerant is turned into a gas-liquid two-phase flow. Thereby, the balance of the gas-liquid flow amount of the refrigerant flowing in or flowing out of the receiver is lost and the gas refrigerant flowing into the receiver pushes down the liquid level, releasing the excessive refrigerant stored in the receiver to the refrigerating cycle. The released excessive refrigerant circulates through the second expanding means and the evaporator provided on the downstream side of the receiver.

Meanwhile, the restriction of the second expanding means is controlled in accordance to the operation of the first expanding means so that the refrigerant at the outlet of the evaporator becomes wet, without being completely gasified. The refrigerant which has been put into the wet state at the outlet of the evaporator flows into the accumulator in the gas-liquid two-phase state having a large dryness. A lower boiling point refrigerant having a higher capacity increases in the gas refrigerant within the two-phase refrigerant having the large dryness, while a higher boiling point refrigerant increases in the liquid refrigerant within the two-phase refrigerant.

Items of the outlet of the accumulator such as the size and withstanding pressure are designed so that the excessive liquid refrigerant flowing therein can be stored, so that the liquid refrigerant containing a large amount of the higher boiling point refrigerant may be stored. Then, because the liquid refrigerant in which the higher boiling point refrigerant has increased is held in the accumulator, the lower boiling point refrigerant increases in the refrigerant circulating within the refrigerating cycle in contrary.

The change described above allows the refrigerating cycle to be operated with the composition of the refrigerant having higher pressure and higher capacity and the capacity of the air conditioner or the refrigerating system to be enhanced as a result.

Further, gas refrigerant mixing means is provided on the pipe, provided in the receiver, for taking out liquid refrigerant to turn the refrigerant at the inlet and outlet of the receiver into the gas-liquid two-phase state, so that the flow within the liquid pipe connecting the indoor unit and the outdoor unit can be always the gas-liquid two-phase flow even if the refrigerant flows in the both directions and the receiver is provided only in the outdoor unit side like a heat pump type air conditioner. As a result, an amount of the refrigerant within the pipe can be decreased and an amount of refrigerant charged be decreased.

Still more, the composition of the refrigerant is changed when a predetermined condition is met based on information on an outside air temperature, a suction temperature of the indoor unit, a discharge pressure, a discharge temperature or a blowoff temperature of the indoor unit, so that the limit of the operable range which is otherwise caused by an increase of an operating pressure when the refrigerating system is operated by increasing the lower boiling point refrigerant may be reduced and the function for varying the composition of the refrigerant may be effectively used.

DETAILED DESCRIPTION OF PREFERRED EMBODIMENT

A preferred embodiment of the present invention will be explained with reference to FIGS. 1 or 2.

Figure 1:
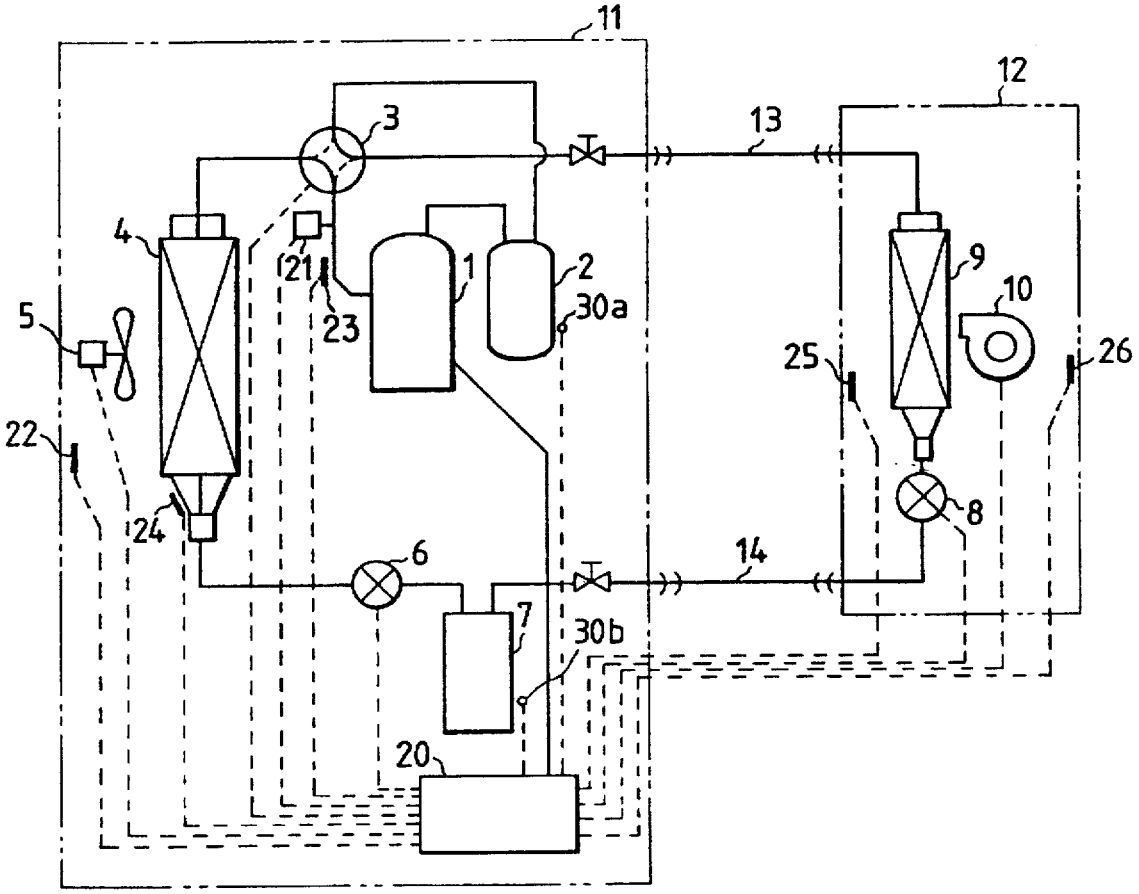
FIG. 1 is a schematic diagram of a refrigerating system according to one preferred embodiment of the present invention.

FIG. 1 shows an air conditioner as a refrigerating system. The air conditioner is constructed by connecting a refrigerant compressor 1, a four-way valve 3, an outdoor unit heat exchanger 4, an outdoor unit expander 6, a receiver 7, an indoor unit expander 8, an indoor unit heat exchanger 9 and an accumulator 2 sequentially by pipes.

An indoor unit fan 10 is disposed near the indoor unit heat exchanger 9. The indoor unit heat exchanger 9 and the indoor unit fan 10 constitute the main part of an indoor unit 12. An outdoor fan 5 is disposed near the outdoor unit heat exchanger 4.

An outdoor unit 11 of the air conditioner comprises the refrigerant compressor 1, the four-way valve 3, the outdoor unit heat exchanger 4, the outdoor unit expander 6, the receiver 7 and the accumulator 2. Among the pipes described above, the one connecting between the indoor unit heat exchanger 9 and the four-way valve 3 is a gas refrigerant connecting pipe 13 and the other one connecting between the receiver 7 and the indoor unit expander 8 is a liquid refrigerant connecting pipe 14.

Each structural element of the outdoor unit 11 and the indoor unit 12 is controlled by a controller 20 provided in the outdoor unit 11. The refrigerant compressor 1 is a scroll type compressor for example and the indoor unit expander 8 and the outdoor unit expander 6 are structured by an electric expansion valve, respectively.

Data input to the controller 20 are:

1) a discharge pressure detected by a pressure detector 21 provided at an outlet of the refrigerant compressor 1;
2) a discharge temperature detected by a discharge temperature sensor 23;
3) an outside air temperature detected by an outside air temperature sensor 22;
4) a temperature of heat-exchanger fluid of the outdoor unit detected by a heat-exchanger fluid temperature sensor 24 attached to the outdoor unit heat exchanger 4;
5) a blowoff temperature detected by a blowoff temperature sensor 25 of the indoor unit provided near a blowoff opening of the indoor unit 12;
6) a suction temperature detected by a suction temperature sensor 26 of the indoor unit provided near a suction opening of the indoor unit 12 or within a room in which the air conditioner is installed;
7) a liquid level detected by a level gauge 30*a* attached to the accumulator 2; and
8) a liquid level detected by a level gauge attached to the receiver 7.

Figure 2:
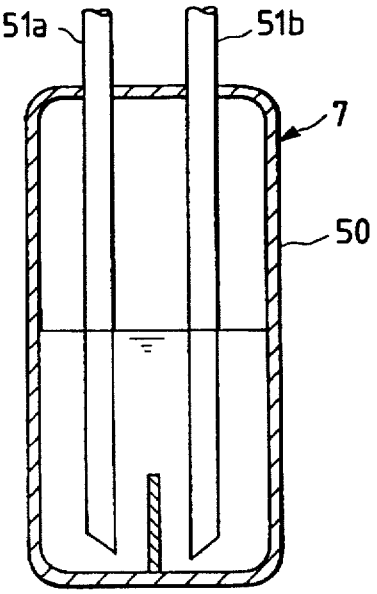
FIG. 2 is a longitudinal section view of a receiver used in the embodiment in FIG. 1.

FIG. 2 is a longitudinal section view illustrating an internal structure of the receiver used in the embodiment shown in FIG. 1, wherein a partition plate erects from the bottom of a container 50 and refrigerant lead-out and lead-in pipes 51*a* and 51*b* are introduced to each chamber partitioned by the partition plate. Refrigerant is charged in the container 50 exceeding the top of the partition plate.

A vapor compressing refrigeration cycle is created in the air conditioner described above and as the refrigerant thereof, it uses non-azeotrophic refrigerant mixtures in which at least more than two kinds of substances having different boiling points are mixed.

The non-azeotrophic refrigerant mixtures is R407C (ASHRAE refrigerant No.) for example in which difluoromethane (HFC 32), pentafluoroethane (HFC 125) and 1,1,1,2-tetrafluoroethane (HFC 134a) are mixed in the ratio of 23:25:52 (weight %). In the refrigerant R407C, the HFC 134a is a higher boiling point refrigerant and the HFC 32 and HFC 125 are lower boiling point refrigerants.

When only the HFC 32 and the HFC 125 are mixed, they have an anon-azeotrophic point and have a property that their boiling points are relatively close.

In the gas-liquid equilibrium state of R407C which is tertiary refrigerant mixtures, the HFC 32 and HFC 125 which have lower boiling points exist on the gas side in the ratio more than the mixed ratio and the HFC 134a which has a higher boiling point exists on the liquid side in the ratio more than the mixed ratio.

Further, an amount of refrigerant more than an amount of that necessary for the adequate operation of the refrigerating cycle is charged.

The operation and effect of the embodiment described above will be explained below.

At first, the normal cooling operation will be explained. When the refrigerant compressor 1, the outdoor unit fan 5 and the indoor unit fan 10 are started, the high temperature and high pressure refrigerant compressed by the refrigerant compressor 1 flows into the outdoor unit heat exchanger 4 via the four-way valve 3 and is condensed as its heat is exchanged with air. Then, it passes through the outdoor unit expander 6 (the electric expansion valve) which is fully opened.

However, because almost no pressure is lost in the state when the outdoor unit expander 6 is fully opened, the refrigerant flows into the receiver 7 without changing its state almost at all. Passing through the receiver 7, the refrigerant reaches to the indoor unit expander 8 via the liquid refrigerant connecting pipe 14, where it is decompressed and is put into a low pressure two-phase state.

Next, the refrigerant evaporates as heat exchange with the room air is performed in the indoor unit heat exchanger 9.

Here, the restriction of the outdoor unit expander 6 is set so that a dryness of the refrigerant at the outlet of the indoor unit heat exchanger 9 becomes a predetermined value.

The evaporated gas refrigerant flows into the accumulator 2 from the gas refrigerant connecting pipe 13 via the four-way valve 3 and returns to the refrigerant compressor 1. This operation is repeated thereafter.

During this operating state, while the refrigerant contains a few bubbles at the inlet of the receiver 7 and its dryness is almost zero, the bubble level gas is condensed by the heat radiating effect of the receiver 7. As a result, a balance of flow mount is taken between the gas refrigerant and the liquid refrigerant at the outlet and inlet of the receiver so that the dryness of the refrigerant at the outlet of the receiver becomes zero.

This adjustment causes the excessive refrigerant to be stored in the receiver 7, removing almost all the excessive refrigerant from the accumulator 2. Thereby, the refrigerating cycle may be stabilized. Further, because the composition of the excessive refrigerant present in the receiver 7 barely changes, the composition of the refrigerant circulating in the refrigerating cycle is not changed significantly from the composition when it has been charged.

Next, the operation and effect when the composition of the refrigerant circulating in the refrigerating cycle is changed so that the HFC 32 and HFC 125 which are the lower boiling point refrigerants increase will be explained below.

When the controller 20 determines that the composition should be changed based on an outside air temperature or the like detected by the outside air temperature sensor 22, the controller 20 issues a signal restricting the restriction of the outdoor unit expander 6.

When the restriction thereof is restricted, the refrigerant at the inlet of the receiver 7 is put into a saturation state, becoming a gas-liquid two-phase flow. Due to that, the balance of the gas-liquid flow amount of the refrigerant flowing in or out of the receiver 7 is lost. The gas refrigerant flowing into the receiver 7 pushes down the liquid level and the excessive refrigerant held within the container of the receiver 7 is released into the refrigerating cycle.

The released excessive refrigerant passes sequentially through the indoor unit expander 8, the indoor unit heat exchanger 9 and the gas refrigerant connecting pipe 13 and flows into the accumulator 2. The controller 20 transmits a signal for opening the restriction of the indoor unit expander 8 in response to the operation of the outdoor unit expander 6 to the indoor unit expander 8. Then, the controller 20 controls the refrigerant at the outlet of the indoor unit heat exchanger 9 so that it becomes wet, not completely gasifying it.

Thereby, the refrigerant flowing into the accumulator 2 is put into the gas-liquid two-phase state and the dryness thereof becomes large. In the gas refrigerant within this two-phase state refrigerant, the lower boiling point refrigerants having a higher capacity is increased.

Various items of the accumulator 2 at the side for outputting the refrigerant, such as diameters of an oil returning orifice and a gas refrigerant lead-out orifice, are designed to have a size which permits the excessive refrigerant flowing into the accumulator 2 to be stored. Thereby, the liquid refrigerant in which HFC 134a which is the higher boiling point refrigerant is increased is stored in the accumulator 2. The refrigerant circulating within the refrigerating cycle is changed so that the lower boiling point refrigerants composed of the HFC 32 and HFC 125 having high capacity thermophysical properties are increased in contrary, it is put into a high pressure state. Accordingly, the refrigerating cycle is operated by the composition of the refrigerant having the higher capacity, thus enhancing the cooling capacity of the air conditioner.

Next, the heating operation will be explained.

During the heating operation, the four-way valve 3 is switched and the refrigerant circulates through, in an order of, the refrigerant compressor 1, the four-way valve 3, the gas refrigerant connecting pipe 13, the indoor unit heat exchanger 9, the indoor unit expander 8, the liquid refrigerant connecting pipe 14, the receiver 7, the outdoor unit expander 6, the outdoor unit heat exchanger 4, the four-way valve 3 and the accumulator 2. Because the indoor unit expander 8 is normally fully opened, the opening of the indoor unit expander 8 is restricted to put the refrigerant into the saturated two-phase state at the inlet of the receiver 7 when the ratio of the composition of the lower boiling point refrigerant is increased. Then, the excessive refrigerant is moved to the accumulator 2 via the outdoor unit heat exchanger 4 and the four-way valve 3.

The operation described above is the same with the case of the cooling operation and thereby, the heating capacity can be enhanced.

Figure 3:
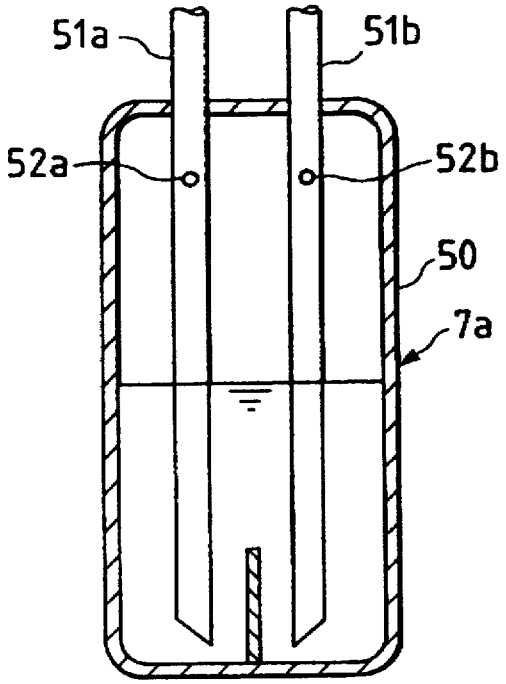
FIG. 3 is a longitudinal section view of a receiver used in another embodiment.

Next, a second embodiment of the present invention will be explained. The system structure is the same with that of the air conditioner of the first embodiment, except of that a receiver shown in FIG. 3 is used instead of the receiver 7. In the receiver **7*a* of the present embodiment, a partition plate erects from the bottom of a container 50 and refrigerant lead-out and lead-in pipes 51*a* and 51*b* are introduced to each chamber partitioned by the partition plate. Gas refrigerant mixing holes 52*a* and 52*b* are created through each of the refrigerant lead-out and lead-in pipes. The refrigerant is charged in the container 50** exceeding the top of the partition plate.

The operation and effect of the second embodiment will be explained. In the receiver **7*a* of the present embodiment, gas refrigerant suctioned from the gas refrigerant mixing hole (either the hole 52*a* or 52*b*) located at the upper part of the refrigerant lead-out/lead-in pipe on the side from which the refrigerant flows out (either the pipe 51*a* or 51*b* as cooling and heating is switched) and liquid refrigerant pulled up from the lower part of the container 50 by the refrigerant lead-out/lead-in pipe are mixed to put the refrigerant at the outlet of the receiver 7*a*** into a gas-liquid two-phase state having a predetermined dryness.

During the normal operation, the controller 20 decides an opening of both of the expander at the inlet side of the receiver **7*a* (the outdoor unit expander 6 during the cooling operation and the indoor unit expander 8 during the heating operation) and the expander at the outlet side of the receiver 7*a* (the indoor unit expander 8 during the cooling operation and the outdoor unit expander 6 during the heating operation) so that the dryness of the refrigerant at the inlet of the receiver 7*a* becomes a predetermined dryness. Then, the balance of the amount of refrigerant flowing out of or flowing into the receiver 7*a* is kept to stabilize the liquid level of the refrigerant within the receiver 7*a*** and to assure the excessive refrigerant.

Thereby, as a result of the expansion in the indoor unit expander 8 during the heating operation, the excessive refrigerant is held within the receiver 7a even when the refrigerant is put into the saturated two-phase state at the inlet of the receiver 7a and the refrigerant flowing through the liquid refrigerant connecting pipe 14 is always put into the saturated two-phase state, so that the amount of refrigerant charged into the refrigerating system may be reduced. Further, because the dryness is small, the change in the composition of the excessive refrigerant is small.

Next, the operation for changing the composition of the refrigerant circulating in the refrigerating cycle in the second embodiment will be explained.

When the composition of the refrigerant is changed so that the HFC 32 and HFC 125 which are the lower boiling point refrigerants increase more than the ratio at the time of charge, the opening of the expander (the outdoor unit expander 6 during the cooling operation and the indoor unit expander 8 during the heating operation) before the receiver 7a is reduced and the opening of the expander (the indoor unit expander 8 during the cooling operation and the outdoor unit expander 6 during the heating operation) at the outlet side of the receiver 7a is increased, similarly to the first embodiment.

It increases the dryness of the refrigerant at the inlet of the receiver 7a and allows the excessive refrigerant within the receiver 7a to be flown out to the refrigerating cycle. That is, the pressure within the receiver 7a which is at the intermediate point between a condensing pressure and an evaporating pressure can be changed by controlling the expanders provided at the inlet and outlet sides of the receiver 7a in an associated manner. Thus the dryness in the receiver 7a changes and the amount of the gas refrigerant flowing into the receiver 7a increases, moving the refrigerant within the receiver 7a to the accumulator 2, so that the composition of the refrigerant circulating within the refrigerating cycle may be changed in the same manner with the first embodiment.

As described above, the present embodiment allows the composition of the circulating refrigerant to be arbitrarily changed, the amount of refrigerant to be reduced and the operation wherein the capacity of the refrigerating system is increased to be realized.

Figure 4:
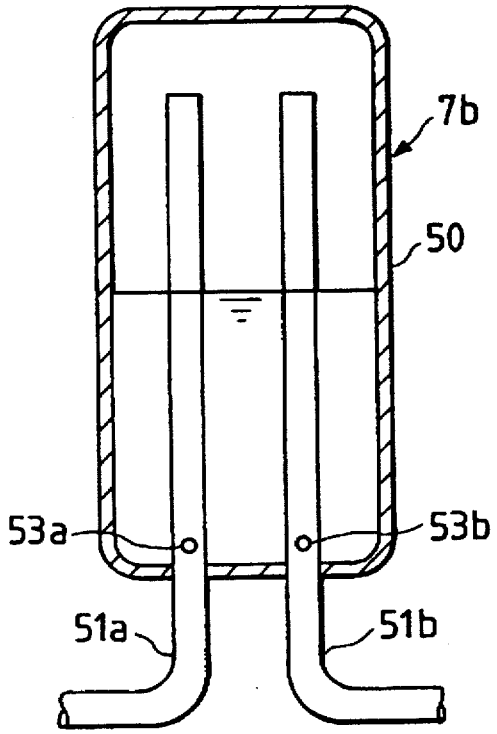
FIG. 4 is a longitudinal section view of a receiver used in a variation of the other embodiment.

FIG. 4 shows a variation of the second embodiment, wherein only a receiver 7b is modified. The receiver 7b has a structure in which the receiver 7a in the second embodiment is turned upside down. Refrigerant lead-out and lead-in pipes 51a and 51b are provided at the lower part of the container 50. Liquid refrigerant stored in the lower part of the container is suctioned up from liquid refrigerant mixing holes 53a and 53b provided on the respective refrigerant lead-out and lead-in pipes to mix with gas refrigerant suctioned from the ends of the refrigerant lead-out and lead-in pipes 51a and 51b to turn into a two-phase flow.

The use of this receiver 7b allows the same operation and effect with the second embodiment to be obtained.

When the composition of the circulating refrigerant is changed so as to increase the lower boiling point refrigerant, the controller 20 generates a signal for changing the composition of the refrigerant when an outside air temperature or a temperature of air suctioned to the heat exchanger reaches to a set value in any of the embodiments described above.

When the capacity is enhanced by changing the composition of the refrigerant, an operating pressure is increased as well. Due to that, when a condensation temperature is high, i.e. when an outside air temperature is high while the cooling operation is performed or when a room temperature is high while the heating operation is performed, it is necessary to provide means for restricting a refrigerant pressure so that it will not exceed a designed pressure of the equipment in advance.

Figure 5:
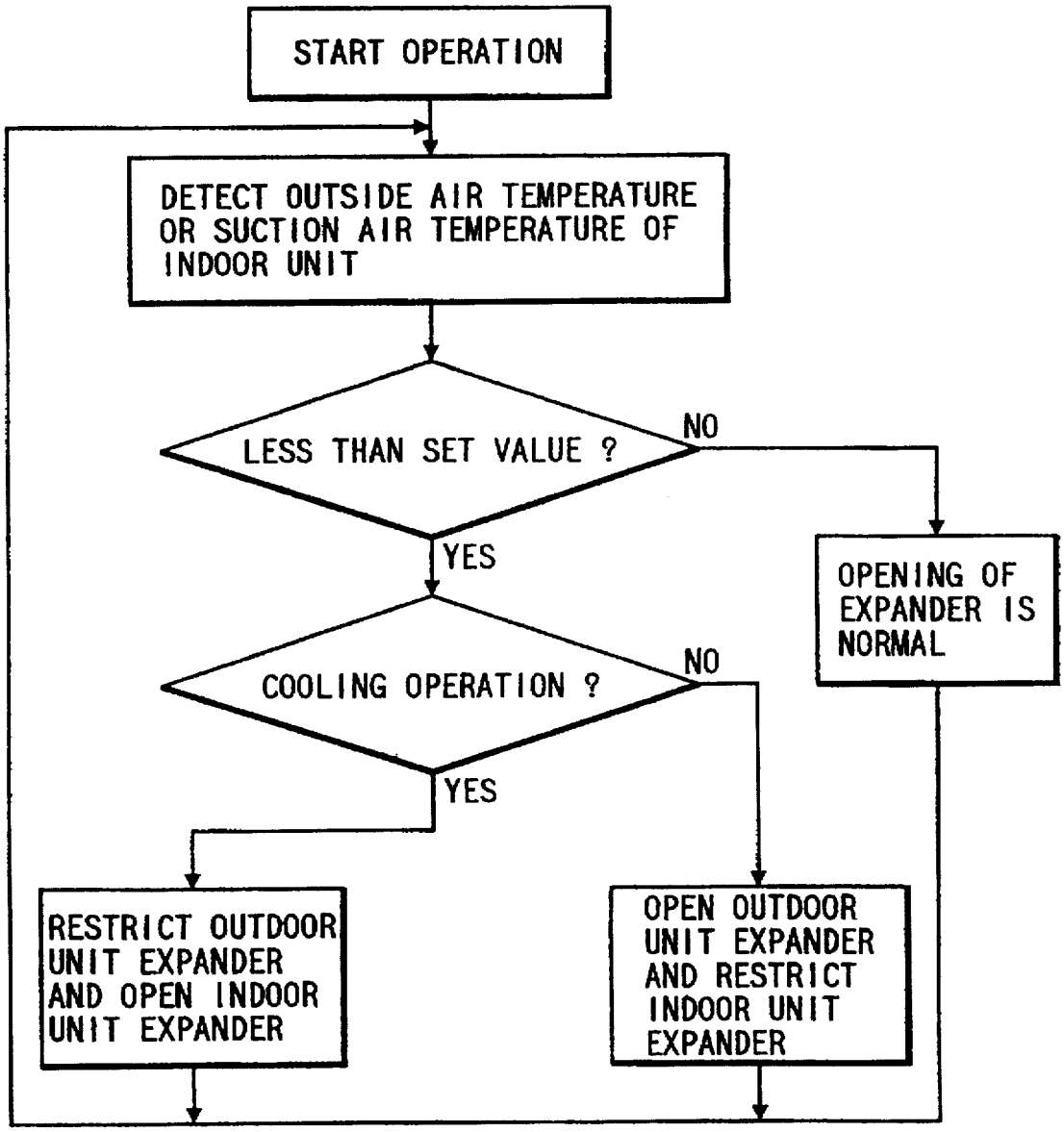
FIG. 5 is a control flow chart according to another embodiment.

Then, the restricting means will be explained below with reference to a flow chart of the control in the first embodiment shown in FIG. 5.

When a value of a temperature detected by the outside air temperature sensor 22 or the indoor unit suction temperature sensor 26 is lower than a set temperature during the operation of the refrigerating system, the opening of the outdoor unit expander 6 and the indoor unit expander 8 is changed to change the composition of the refrigerant circulating within the refrigerating cycle.

A variation of the composition may be detected by using liquid level detecting means of the accumulator 2 or circulating composition detecting means and the controller 20 decides the opening of the expanders so that the composition of the refrigerant turns into a predetermined composition.

The control described above for increasing the lower boiling point refrigerant within the circulating refrigerant may be eliminated by monitoring each structural equipment so that they will not deviate their operating limit by using a pressure detector 21 using a pressure sensor or a pressure switch, a discharge temperature sensor 23 and the indoor unit blowoff temperature sensor 25, etc.

During the defrosting operation, the refrigerant flow direction is the same as that during the cooling operation. As described in the explanation of the cooling mode, the refrigeration cycle is operated by the composition of the refrigerant having the higher capacity to enhance the cooling capacity. Therefore the defrosting operation may be finished in a short time, thus enhancing the comfortableness, by incorporating the control for changing the composition in the defrosting operation for removing frost of the outdoor unit heat exchanger 4 during the heating operation.

As described above, the present invention makes the complicated structure such as the rectifier unit and the control method thereof unnecessary and allows the composition of the refrigerant circulating within the refrigerating cycle to be changed just by using the structural elements which the refrigerating cycle is conventionally equipped with. Accordingly, the refrigerating cycle may be operated by way of the ratio of composition of the refrigerant, which has been unable to be used due to the restriction on the pressure level of the system in the past.

Specifically, because the refrigerating cycle can be shifted to the operation of increasing the lower boiling point refrigerant, the capacity of the air conditioner may be enhanced by the mechanism at low cost.

Further, because it is a simple mechanism, it requires no complicated control, providing a stable refrigerating cycle and improving the reliability of the equipments.

Still more, it allows the reduction of the amount of refrigerant charged, the reduction of the cost of each structural equipment of the refrigerating cycle, the reduction of an amount of the refrigerant released to the, atmosphere to the minimum when the system is decomposed or adjusted and the elimination of the cause of the global warming and the environmental pollution.

What is claimed is:

1. A refrigerating system in which an indoor unit and an outdoor unit are connected by pipes and which uses non-azeotrophic refrigerant mixtures, comprising:

an outdoor unit expander whose restriction may be changed;

an indoor unit expander whose restriction may be changed similarly;

a receiver provided between said outdoor unit expander and said indoor unit expander; and a controller for turning both of a refrigerant flow at the inlet of said receiver and a refrigerant flow at the outlet thereof into a gas-liquid two-phase flow by changing the restriction of said outdoor unit expander and said indoor unit expander.

2. The refrigerating system according to claim 1, wherein said non-azeotrophic refrigerant mixtures is what at least either difluoromethane or pentafluoroethane is mixed with 1,1,1,2-tetrafluoroethane.

3. The refrigerating system according to claim 1, further comprising indoor unit temperature detecting means, provided in said indoor unit, for detecting a suction temperature of said indoor unit, the restriction of said outdoor unit expander and said indoor unit expander being controlled based on said suction temperature of said indoor unit.

4. The refrigerating system according to claim 1, further comprising indoor unit blowoff temperature detecting means, provided in said indoor unit, for detecting a blowoff temperature of said indoor unit, the restriction of said outdoor unit expander and said indoor unit expander being controlled based on the blowoff temperature of said indoor unit.

5. The refrigerating system according to claim 1, wherein said non-azeotrophic refrigerant mixtures is R407C.

6. A refrigerating system having a refrigerating cycle constructed by connecting a refrigerant compressor, condenser, a receiver, an evaporator and an accumulator sequentially by pipes and whose refrigerant circulating within said refrigerating cycle is non-azeotrophic refrigerant mixtures in which at least more than two kinds of substances having different boiling points are mixed, comprising:

first expanding means which is provided on the upstream side of said receiver and whose restriction may be changed;

second expanding means which is provided on the downstream side of said receiver and whose restriction may be changed; and control means for turning both of a refrigerant flow at the inlet of said receiver and a refrigerant flow at the outlet thereof into a gas-liquid two-phase flow by changing the restriction of said first expanding means and said second expanding means.

7. The refrigerating system according to claim 6, further comprising:

a pipe, provided in said receiver, for taking out the liquid refrigerant; and gas refrigerant mixing means provided on said pipe for taking out the liquid refrigerant.

8. The refrigerating system according to claim 6, further comprising outside air temperature detecting means, provided in said refrigerating system, for detecting an outside air temperature, the restriction of said first expanding means and said second expanding means being controlled based on said outside air temperature.

9. The refrigerating system according to claim 2, wherein said refrigerant compressor is equipped with discharge temperature detecting means for detecting a discharge temperature, the restriction of said first expanding means and said second expanding means being controlled based on said discharge temperature.

10. The refrigerating system according to claim 2, wherein said refrigerant compressor is equipped with discharge pressure detecting means for detecting a discharge pressure, the restriction of said first expanding means and said second expanding means being controlled based on said discharge pressure.

11. A refrigerating system having a refrigerating cycle constructed by connecting a refrigerant compressor, condenser, a receiver, an evaporator and an accumulator sequentially by pipes and whose refrigerant circulating within said refrigerating cycle is non-azeotrophic refrigerant mixtures in which more than at least two kinds of substances having different boiling points are mixed, comprising:

first expanding means which is provided on the upstream side of said receiver and whose restriction may be changed;

second expanding means which is provided on the downstream side of said receiver and whose restriction may be changed; and control means for reducing liquid refrigerant within said receiver and increasing liquid refrigerant within said accumulator by changing the restriction of said first expanding means and said second expanding means.

12. A method for operating a refrigerating system equipped with an indoor unit and an outdoor unit comprising a refrigerant compressor, an outdoor unit heat exchanger, a receiver and an accumulator and using non-azeotrophic refrigerant mixtures, characterized in that an amount of said non-azeotrophic refrigerant mixtures stored in said accumulator is increased during the heating operation when an outside air temperature drops.

13. The method for operating the refrigerating system according to claims 12, wherein said non-azeotrophic refrigerant mixtures is R407C.

14. A method for operating a refrigerating system equipped with an indoor unit and an outdoor unit comprising a refrigerant compressor, an outdoor unit heat exchanger, a receiver and an accumulator, and using non-azeotrophic refrigerant, stored in said accumulator and increased during the defrosting operation by controlling an indoor unit expander and an outdoor unit expander associated therewith.

15. A method for operating a refrigerating system equipped with an indoor unit and an outdoor unit comprising a refrigerant compressor, an outdoor unit heat exchanger, a receiver and an accumulator and using non-azeotrophic refrigerant mixtures, characterized in that restriction of an outdoor unit expander and an indoor unit expander is controlled to increase lower boiling point refrigerants of said non-azeotrophic refrigerant mixtures circulating within the refrigerating cycle during the heating operation when an outside air temperature drops.

16. The method for operating the refrigerating system according to claim 15, wherein the restriction of said outdoor unit expander and said indoor unit expander is controlled based on at least either an outside air temperature or a suction temperature of said indoor unit.

17. A method for operating a refrigerating system equipped with an indoor unit and an outdoor unit comprising a refrigerant compressor, an outdoor unit heat exchanger, a receiver and an accumulator and using non-azeotrophic refrigerant mixtures, characterized in that an amount of said non-azeotrophic refrigerant mixtures stored in said receiver provided between an outdoor unit expander and an indoor unit expander is decreased during the heating operation when an outside air temperature drops.

* * * * *